US010195872B2

(12) United States Patent
Tashiro et al.

(10) Patent No.: US 10,195,872 B2
(45) Date of Patent: Feb. 5, 2019

(54) LABEL PRINTER

(71) Applicant: Ishida Co., Ltd., Kyoto (JP)

(72) Inventors: Souhei Tashiro, Ritto (JP); Kengo Aoyama, Ritto (JP); Tamaki Matsuura, Ritto (JP); Naoki Komai, Ritto (JP); Suguru Doiguchi, Tokyo (JP); Osamu Hiraiwa, Ritto (JP)

(73) Assignee: Ishida Co., Ltd., Kyoto (JP)

( * ) Notice: Subject to any disclaimer, the term of this patent is extended or adjusted under 35 U.S.C. 154(b) by 0 days.

(21) Appl. No.: 15/549,440

(22) PCT Filed: Feb. 9, 2016

(86) PCT No.: PCT/JP2016/053855

§ 371 (c)(1),
(2) Date: Aug. 8, 2017

(87) PCT Pub. No.: WO2016/129604

PCT Pub. Date: Aug. 18, 2016

(65) Prior Publication Data

US 2018/0022113 A1 Jan. 25, 2018

(30) Foreign Application Priority Data

Feb. 9, 2015 (JP) ..... 2015-023512
Mar. 20, 2015 (JP) ..... 2015-057428
Jul. 6, 2015 (JP) ..... 2015-134926

(51) Int. Cl.
*B41J 3/407* (2006.01)
*B41J 2/32* (2006.01)
(Continued)

(52) U.S. Cl.
CPC ..... *B41J 3/4075* (2013.01); *B41J 2/32* (2013.01); *B41J 3/36* (2013.01); *B41J 3/46* (2013.01);
(Continued)

(58) Field of Classification Search
CPC ... B41J 3/4075; B41J 3/46; B41J 29/38; B41J 2/32; B41J 13/26; B41J 11/70
See application file for complete search history.

(56) References Cited

U.S. PATENT DOCUMENTS 2,170,147 A 8/1939 Lane
3,692,176 A 9/1972 Templeton et al.
(Continued)

FOREIGN PATENT DOCUMENTS

CN 1983074 A 6/2007
JP H02-001742 B2 1/1990
(Continued)

OTHER PUBLICATIONS

Machine-generated translation of JP 2001-031039, published on Feb. 2001.*
(Continued)

*Primary Examiner* — Huan Tran
(74) *Attorney, Agent, or Firm* — Studebaker & Brackett PC

(57) ABSTRACT

A label printer is configured to sequentially issue a reserved number of printed labels on which information on a reserved commodity is printed, and the label printer includes: a designation means configured to designate a commodity; an input means configured to input the number of printed labels to be issued on which information on the commodity designated by the designation means is printed; and a registration means configured to receive, while the printed labels are issued, designation of the commodity by the designation means and input of the number of printed labels to be issued by the input means, and register a reservation.

26 Claims, 12 Drawing Sheets

(51) Int. Cl.

| | |
|---|---|
| ***B41J 3/46*** | (2006.01) |
| ***B41J 11/70*** | (2006.01) |
| ***B41J 13/26*** | (2006.01) |
| ***B41J 29/38*** | (2006.01) |
| ***B41J 3/36*** | (2006.01) |
| ***B41J 29/42*** | (2006.01) |

(52) U.S. Cl.

CPC ..... *B41J 11/70* (2013.01); *B41J 13/26* (2013.01); *B41J 29/38* (2013.01); *B41J 29/42* (2013.01)

(56) References Cited

U.S. PATENT DOCUMENTS

| | | | | |
|---|---|---|---|---|
| 4,009,065 | A | 2/1977 | Mikulas | |
| 5,226,560 | A | 7/1993 | Jones | |
| 5,324,078 | A | 6/1994 | Bane | |
| 6,379,790 | B1 | 4/2002 | Langan | |
| 7,503,995 | B2 | 3/2009 | Hayasaka | |
| 7,541,080 | B2 | 6/2009 | Mass et al. | |
| 2002/0113428 | A1 | 8/2002 | Phillips et al. | |
| 2006/0134365 | A1 | 6/2006 | Blank et al. | |
| 2006/0263594 | A1 | 11/2006 | Kraft et al. | |
| 2007/0139690 | A1* | 6/2007 | Fukushima | G03G 15/5012 358/1.14 |
| 2008/0250353 | A1 | 10/2008 | Konuma | |
| 2010/0156087 | A1 | 6/2010 | Raming | |
| 2016/0114596 | A1* | 4/2016 | Komai | B41J 3/4075 347/110 |

FOREIGN PATENT DOCUMENTS

| | | | |
|---|---|---|---|
| JP | H04-232986 | A | 8/1992 |
| JP | 2001-031039 | A | 2/2001 |
| JP | 3205804 | B2 | 7/2001 |
| JP | 2007-166454 | A | 6/2007 |
| JP | 2008-041048 | A | 2/2008 |
| JP | 2008-257580 | A | 10/2008 |
| JP | 2011-235966 | A | 11/2011 |
| JP | 5055887 | B2 | 10/2012 |
| JP | 2013-086416 | A | 5/2013 |
| JP | 2013-111962 | A | 6/2013 |
| JP | 2014-215386 | A | 11/2014 |
| JP | 2015-009514 | A | 1/2015 |
| WO | 2012/014958 | A1 | 2/2012 |
| WO | 2013/128629 | A1 | 9/2013 |

OTHER PUBLICATIONS

International Search Report issued in PCT/JP2016/053855, dated Apr. 5, 2016.

Extended European Search Report issued by the European Patent Office dated Mar. 24, 2016, which corresponds to EP15191772.1-1707 and is related to U.S. Appl. No. 15/549,440.

Office Action issued by the U.S. Patent and Trademark Office dated Dec. 2, 2016, which corresponds to U.S. Appl. No. 14/921,748 and is related to U.S. Appl. No. 15/549,440.

International Preliminary Report on Patentability issued in PCT/JP2016/053855, dated Aug. 15, 2017.

A Notice of Allowance issued by the United States Patent and Trademark Office dated May 9, 2018, which corresponds to U.S. Appl. No. 14/921,748 and is related to U.S. Appl. No. 15/549,440.

* cited by examiner

*Fig.6*

431

| COMMODITY NUMBER | NAME | UNIT PRICE | FIXED PRICE | EXPIRATION DATE |
|---|---|---|---|---|
| 000001 | KOBE BEEF FILET STEAK | | 300 | |
| . | | | | |
| 000013 | BROILER CHICKEN BREAST | | 300 | |
| . | | | | |
| 000348 | ASSORTED SEAFOOD (FOR SASHIMI) | 498 | | |
| 000400 | SEAFOOD SALAD | 198 | | |
| . | | | | |
| 002115 | SEAFOOD HAND-ROLLED SUSHI SET (SMALL) | | | |

LABEL PRINTER

TECHNICAL FIELD

The present invention relates to a label printer.

BACKGROUND ART

In supermarkets and the like, when affixing fixed price labels with a specified price to commodities such as prepared foods or boxed lunches, a clerk or the like issues a plurality of fixed price labels at a time using a label printer, and affixes the plurality of fixed price labels one by one to the boxed lunches and the like arranged on a display table.

The label printer that issues such fixed price labels is described in Patent Literature 1 below. A liner label is used in the label printer. Print contents and the number of labels to be issued are reserved in association with each of a plurality of commodities, so that a reserved number of printed labels can be continuously issued for each of the reserved commodities. When a clerk or the like performs the affixing work, the clerk makes the label printer continuously issue a reserved number of fixed price labels for each of the reserved commodities.

CITATION LIST

Patent Literature

Patent Literature 1: Japanese Examined Patent Publication No. H2-1742

SUMMARY OF INVENTION

Technical Problem

It is desirable for such a label printer to cause the timing at which commodities to be subsequently processed are ready to coincide with the timing at which printed labels to be affixed to the commodities are issued.

In this regard, an object of the present invention is to provide a label printer capable of causing the timing at which commodities to be subsequently processed are ready to coincide with the timing at which printed labels to be affixed to the commodities are issued.

Solution to Problem

A label printer according to an aspect of the present invention is configured to sequentially issue a reserved number of printed labels on which information on a reserved commodity is printed, and the label printer includes: a designation means configured to designate a commodity; an input means configured to input the number of printed labels to be issued on which information on the commodity designated by the designation means is printed; and a registration means configured to receive, while the printed labels are issued, designation of the commodity by the designation means and input of the number of printed labels to be issued by the input means, and register a reservation.

Consequently, even during the issuance of the printed labels, the issuance of the printed labels for the commodities to be subsequently processed can be reserved. Therefore, the timing at which the commodities to be subsequently processed are ready can coincide with the timing at which the printed labels to be affixed to the commodities are issued.

Thus, as soon as a series of fixed price labels is issued and removed from the label printer, the fixed price labels can be affixed to the commodities.

According to an embodiment, the label printer may further include a display means configured to display a list of reservation contents registered by the registration means. During the work of sequentially affixing the fixed price labels to the commodities such as the boxed lunches arranged on the display table, the types of commodities must always correspond to the labels affixed to the commodities. Therefore, when the issuance of labels for a plurality of commodities is reserved, work order needs to coincide with issuance order for the reserved labels. As used herein, the work order means, for example, that 10 popular boxed lunches are made first, and 20 daily special boxed lunches are made subsequently. If the order is changed or interrupted by another commodity, the issued fixed price labels need to be temporarily put on hold. According to the label printer of an embodiment, the issuance order for the printed labels for the reserved commodities can be confirmed, whereby whether the work order coincides with the label issuance order can be confirmed. Consequently, a mistake in reservation order can be prevented.

According to an embodiment, the label printer may further include a changing means configured to change issuance order for printed labels for commodities reserved by the registration means. After the issuance of labels for a plurality of commodities is reserved, if the work order is suddenly changed or interrupted by an additional commodity, the problem of a bothersome process for handling the reserved or issued label sheet occurs. According to the label printer of an embodiment, even when a mismatch occurs between the work order and the label issuance order, the issuance order is changed, the reserved commodity is erased, or the top commodity in the issuance order is replaced by a new commodity, whereby the mismatch can be resolved.

According to an embodiment, the label printer may further include: a print unit configured to print a linerless label while feeding the linerless label wound in a roll shape; a cutter arranged on a downstream side of the print unit to cut the printed linerless label to a predetermined length; and a temporary adhesion unit configured to hold from front and rear sides the printed label, being the printed linerless label cut by the cutter, and to adhere a rear end portion of the printed label to a front end portion of a subsequent printed label fed subsequent to the printed label.

According to an embodiment, the label printer may further include: a print unit configured to print a linerless label while feeding the linerless label wound in a roll shape; a cutter arranged on a downstream side of the print unit to cut the printed linerless label to a predetermined length; and a temporary adhesion unit configured to hold from front and rear sides the printed label, being the printed linerless label cut by the cutter, and to adhere an upstream end portion in a feeding direction of the printed label to a downstream end portion in a feeding direction of a subsequent printed label fed subsequent to the printed label.

What is called a linerless label, i.e., a label including a sticking surface to which a liner (release paper) is not affixed, has been used recently. In a case where such a linerless label is used, a printed label is cut from a label roll every time the printed label is printed. Such a linerless label cannot be used for issuing printed labels in a linked-sheet shape, unlike a conventional liner label. The label printer having the above configuration can cause the rear end portion of the cut printed label to adhere to the front end portion of the subsequent printed label fed subsequent to the printed label, and issue sheet-like printed labels including a plurality of linked printed labels.

According to the label printer having the above configuration, the front end portions of the subsequent printed labels are affixed to the rear end portions of the preceding printed labels one after another every time the printed label is issued from the linerless label. Therefore, a series of printed labels linked in a sheet shape can be issued while these printed labels are issued one by one as linerless labels. In addition, even though the print amount varies in accordance with the commodity, the length of the printed label to be issued can be changed. Therefore, the versatility can be improved, as compared with the versatility of the liner label in which a single printed label has a predetermined fixed dimension. Moreover, since blanks in which nothing is printed can be minimized, the amount of label usage per commodity can be reduced.

After the conventional liner label is issued, it can be left as it is without any problem since the printed label remains affixed to the liner. However, in the case of the linerless label, if a plurality of printed labels is continuously issued and removed from the label printer, and the issued label sheet is handled in a wrong way, since the sticking surfaces remain exposed, the printed labels are likely to cling to each other or stick to a label issuing device, an object around the label issuing device, a wall, or a floor. This causes the problem of making the printed labels unusable.

According to the label printer having the above configuration, as soon as a series of fixed price labels is issued and removed from the label printer, the fixed price labels can be affixed to the commodities. Therefore, a series of labels is no longer left as it is with the sticking surfaces thereof exposed, and damage to the issued labels or a mistake in handling the issued labels can be eliminated even during the use of the linerless label.

Although the linerless label is preferably used in this description, the liner label may also be used. The label printer is preferably a dual-purpose label printer capable of printing and issuing both the liner label and the linerless label. However, the label printer may be a dedicated label printer capable of printing and issuing only one of these labels.

According to an embodiment, the label printer may be configured so that when issuance of a number of printed labels reserved by the registration means is finished, the print unit prints a notification label indicating a boundary between the printed label reserved by the registration means and the printed label to be subsequently printed. For example, the notification label is a blank label, a label with a printed mark, or the like. The notification label is issued after a preceding group of printed labels is issued, and connected to the rear end portion of the preceding group of printed labels. A subsequent group of printed labels is further connected to the rear end portion of the notification label. As a result, an operator can identify the boundary between the preceding group and the subsequent group, and remove the issued printed labels collectively on a group basis. Since the operator can identify the boundary between the preceding group and the subsequent group, the mistake of simultaneously removing the preceding group of commodity labels and the subsequent group of commodity labels can be prevented.

Instead of the notification label, for example, a small dot may be printed in a right margin of each of the printed labels included in the preceding group, and a small dot may be printed in a left margin of each of the printed labels included in the subsequent group. In this way, the preceding group and the subsequent group can be discriminated from each other since the boundary between the preceding group and the subsequent group is found at the part where the arrangement of the dots is changed from right to left.

According to an embodiment, the label printer may further include a switching mechanism capable of switching a position of the temporary adhesion unit with respect to the print unit in a direction approximately perpendicular to the feeding direction of the printed label and to a direction perpendicular to a print surface of the printed label, and the switching mechanism may switch the position of the temporary adhesion unit when issuance of a number of printed labels reserved by the registration means is finished.

Owing to this configuration, the temporary adhesion unit for the printed labels is shifted in a left-right direction by a predetermined amount with respect to the print unit once the printing of the preceding group of printed labels is finished. Consequently, the adjacent printed labels included in the different groups can be shifted from each other. Alternatively, the temporary adhesion unit for the printed labels is shifted in the left-right direction by a predetermined amount with respect to the print unit every time the printed label is issued, regardless of the group. Consequently, the printed labels are stacked while being shifted in the left-right direction one by one, and the shift direction and/or shift amount of the adjacent printed labels included in the different groups can be relatively increased. As a result, the operator can identify the boundary between the preceding group and the subsequent group, and remove the issued printed labels collectively on a group basis.

According to an embodiment, the label printer may further include: a detection sensor configured to detect presence or absence of the issued printed label at a label issuing port; and a safety means configured to stop issuance of the next printed label if the printed label is detected by the detection sensor after a predetermined number of the printed labels are issued.

In a case where the linerless label is used in the label printer, a plurality of linerless labels is issued in a linked-sheet shape. Therefore, the issued printed labels are likely to have a large length. If the printed labels are too long, the printed labels are liable to stick to the surroundings, i.e., the outer surface of the label printer, an object placed in the vicinity of the label printer, a wall, a floor, or the like. Therefore, during the use of the label printer, if a predetermined number of printed labels are issued and still present at the label issuing port, the issuance of the next printed label is temporarily stopped. Specifically, the issuance of the next printed label is stopped before the issued printed labels linked to each other reach such a length as to stick to the surroundings. Consequently, the printed labels can be prevented from sticking to the outer surface of the label printer, an object placed in the vicinity of the label printer, a wall, a floor, or the like.

According to an embodiment, the label printer may further include a switching means configured to switch, in accordance with an amount of print data for printing information on a commodity reserved by the registration means, between a multiple-label issuance mode in which a printed label for the commodity is issued separately as a plurality of printed labels and an issuance mode in which the printed label for the commodity is not separately issued.

For example, examples of the print data may include the name and price or the like of the commodity, raw materials and additives for the commodity, and a cooking method for the commodity. Therefore, the switching means may separately issue, for example, a name label including the name and price or the like of the commodity and an auxiliary label including other data in accordance with the amount of print data for printing the information on the commodity. The latter auxiliary label may further be issued separately as an additive label and a recipe label. The name label may be affixed to the front side of the commodity, and the other labels may be affixed to the rear side of commodity. Consequently, not only a single printed label but also two or three printed labels can be issued for a single commodity in accordance with the amount of print data.

In a case where a plurality of labels (name label, auxiliary label, and the like) needs to be affixed to each of a plurality of commodities, a second switching means may be provided to select whether the same labels are collectively issued and affixed to the respective commodities or the plurality of labels is issued in order and affixed to each of the commodities. For example, in a case where the name, additive, and recipe labels are affixed to a single commodity as mentioned above, the workability might be better when the same labels are collectively issued and affixed to the respective commodities, and thereafter the next labels are issued than when these labels are issued in order and affixed to each of the commodities. In such a case, the second switching means is operated to set a collective issuance mode. For example, in a case where there are five identical commodities, five name labels are issued first, and the issued name labels are affixed to the front sides of the respective commodities. Next, five additive labels are issued, and the issued additive labels are affixed to the rear sides of the respective commodities. The labels are issued in this manner, whereby the workability may be improved.

According to an embodiment, the label printer may further include a control unit configured to receive a setting for an upper limit of the number or length of printed labels that are issued to be linked to each other in a front-rear direction, and stop issuance of the printed label when the number or length of printed labels reaches the upper limit.

A label printer according to an aspect of the present invention includes: a print unit configured to print a linerless label while feeding the linerless label wound in a roll shape; a cutter arranged on a downstream side of the print unit to cut the printed linerless label to a predetermined length; a temporary adhesion unit configured to hold from front and rear sides the printed label, being the printed linerless label cut by the cutter, and to adhere a rear end portion of the printed label to a front end portion of a subsequent printed label fed subsequent to the printed label; and a control unit configured to receive a setting for an upper limit of the number or length of printed labels that are issued to be linked to each other in a front-rear direction, and stop issuance of the printed label when the number or length of printed labels reaches the upper limit.

A label printer according to an aspect of the present invention includes: a print unit configured to print a linerless label while feeding the linerless label wound in a roll shape; a cutter arranged on a downstream side of the print unit to cut the printed linerless label to a predetermined length; a temporary adhesion unit configured to hold from front and rear sides the printed label, being the printed linerless label cut by the cutter, and to adhere an upstream end portion in a feeding direction of the printed label to a downstream end portion in a feeding direction of a subsequent printed label fed subsequent to the printed label; and a control unit configured to receive a setting for an upper limit of the number or length of printed labels that are issued to be linked to each other in a front-rear direction, and stop issuance of the printed label when the number or length of printed labels reaches the upper limit.

Owing to this configuration, if a predetermined number of printed labels are issued and still present at the label issuing port, the issuance of the next printed label is temporarily stopped. Specifically, the issuance of the next printed label is stopped before the issued printed labels linked to each other reach such a length as to stick to the surroundings. Consequently, the printed labels can be prevented from sticking to the outer surface of the label printer, an object placed in the vicinity of the label printer, a wall, a floor, or the like.

The length that makes the printed labels stick to the surroundings depends on the direction of feeding the printed label, the length of a single printed label, the stiffness of the printed label, and the environment where the label printer is arranged. Therefore, how many printed labels are continuously issued or how long the printed labels are continuously issued to stick to the surroundings is preferably obtained in advance in accordance with the type of printed label for use or the amount of print data. The limit of the number or length of printed labels at or below which the printed labels do not stick to the surroundings may be registered as a predetermined number or predetermined length of printed labels in association with each commodity. The reason why the limit is registered in association with each commodity is that the amount of print data varies in accordance with the commodity, and the feed length of the label varies in accordance with the amount of print data.

According to an embodiment, the label printer may further include a detection sensor configured to detect presence or absence of the issued printed label at a label issuing port, and the control unit may stop issuance of the next printed label if the printed label is detected by the detection sensor after the number or length of the printed labels reaches a predetermined number or predetermined length at the label issuing port.

According to this configuration, if the printing is detected by the detection sensor even after the number or length of issued printed labels reaches the predetermined number or predetermined length, the safety means (or the control unit) stops the issuance of the next label. Therefore, the problem of continuously issuing long printed labels that are likely to stick to the surroundings can be prevented.

According to an embodiment, the control unit may proceed to issue the next printed label if removal of the printed label at the label issuing port is detected by the detection sensor before the number or length of the printed labels at the label issuing port reaches the predetermined number or predetermined length.

According to an embodiment, the control unit may obtain (calculate) the number or length of the printed labels at the label issuing port every time the printed label is issued.

According to an embodiment, when the control unit determines removal of the printed label from the label issuing port based on a detection signal provided by the detection sensor, the control unit may clear the number or length of the printed labels at the label issuing port obtained in advance. In this manner, the label printer may prepare for the issuance of the next printed label.

The above-described operation continues until the issuance of a reserved number of labels registered is finished. Specifically, in response to the detection sensor detecting the removal of the printed label from the label issuing port, the issuance of the printed label is automatically restarted. Therefore, after starting the operation of issuing the reserved labels, the operator only needs to remove the issued printed labels linked to each other from the label issuing port, and affix the printed labels to the commodities, and does not need to operate the label printer any more. Thus, the workability is significantly improved. In this case, an alarm means can be provided to notify the operator to temporarily stop issuing the label using sound or light, thereby prompting the operator to remove the issued labels.

According to an embodiment, when print contents of the printed label to be subsequently issued are different from print contents of the printed label most recently issued, the control unit may stop issuance of the printed label to be subsequently issued until removal of the printed label at the label issuing port is no longer detected by the detection sensor.

According to this configuration, the printed labels having different print contents cannot be simultaneously present at the label issuing port, whereby the mistake of affixing wrong printed labels to the respective commodities can be prevented. In this case, sound and/or light are preferably emitted by the alarm means in the above-mentioned manner. However, the sound and/or light for this case preferably have a tone and/or wavelength different from those of the above-mentioned sound and/or light.

Advantageous Effects of Invention

According to the present invention, the timing at which commodities to be subsequently processed are ready can coincide with the timing at which printed labels to be affixed to the commodities are issued. Thus, as soon as a series of fixed price labels is issued and removed from the label printer, the fixed price labels can be affixed to the commodities.

BRIEF DESCRIPTION OF DRAWINGS

FIG. 6 is an example of commodity information registered with a commodity master.

FIG. 11(*b*) is a diagram illustrating a schematic configuration of the moving mechanism included in the label printer of FIG. 10, and illustrating the free roller positioned in a second position.

DESCRIPTION OF EMBODIMENTS

Figure 1:
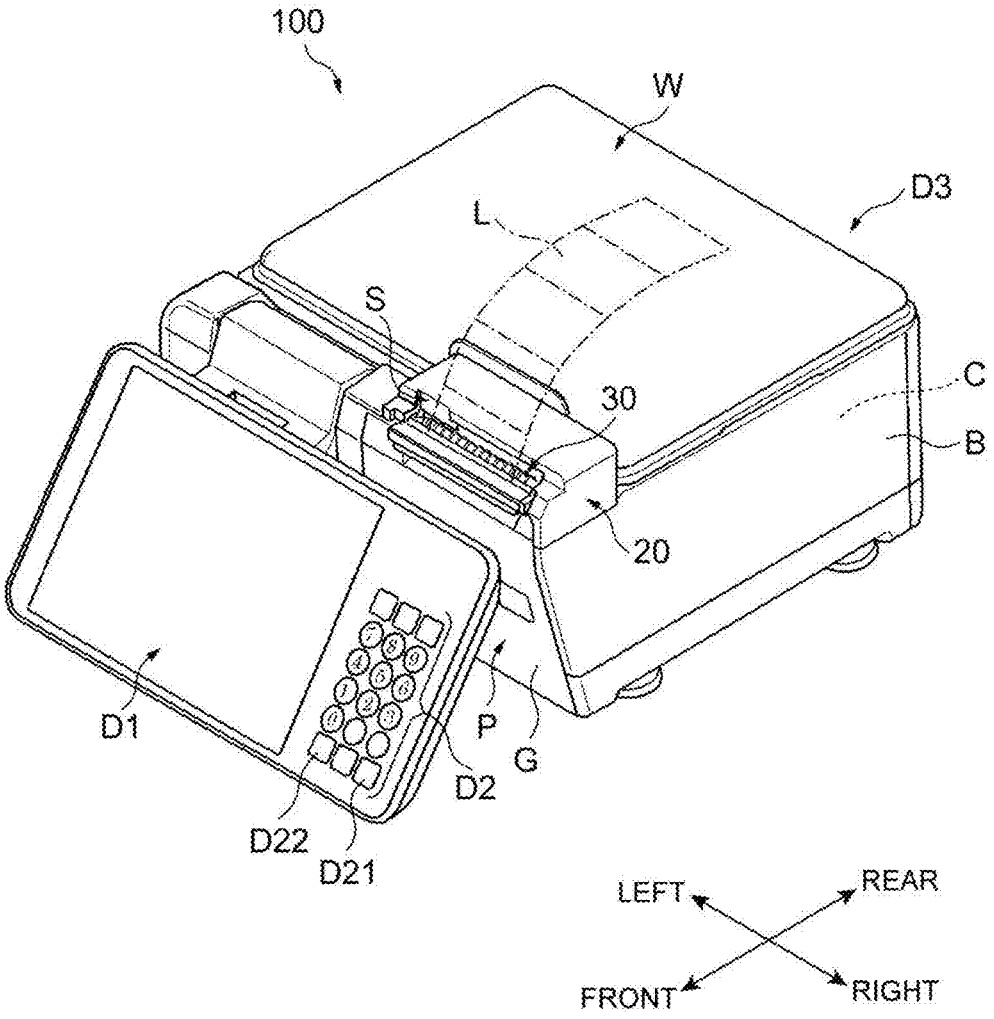
FIG. 1 is an external perspective view of an electronic balance equipped with a label printer according to an embodiment.
Figure 2:
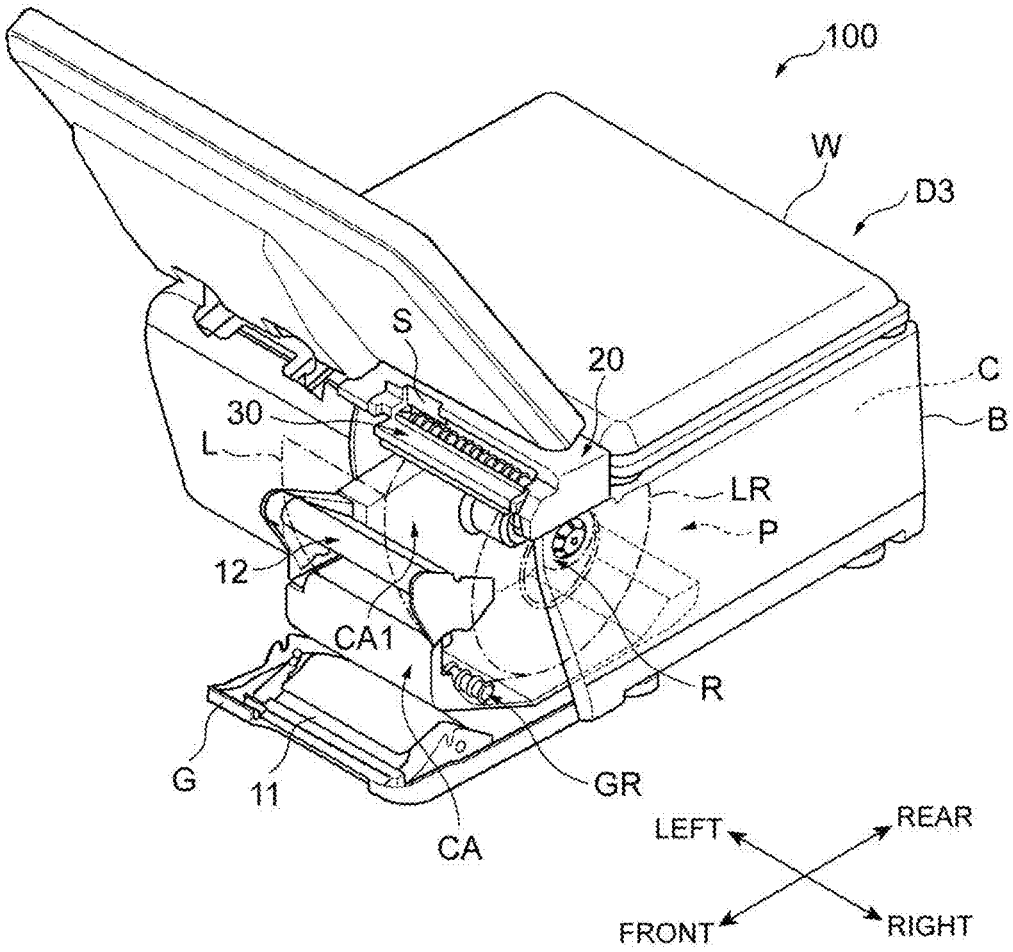
FIG. 2 is a perspective view of the electronic balance with a label cassette pulled out therefrom.
Figure 3:
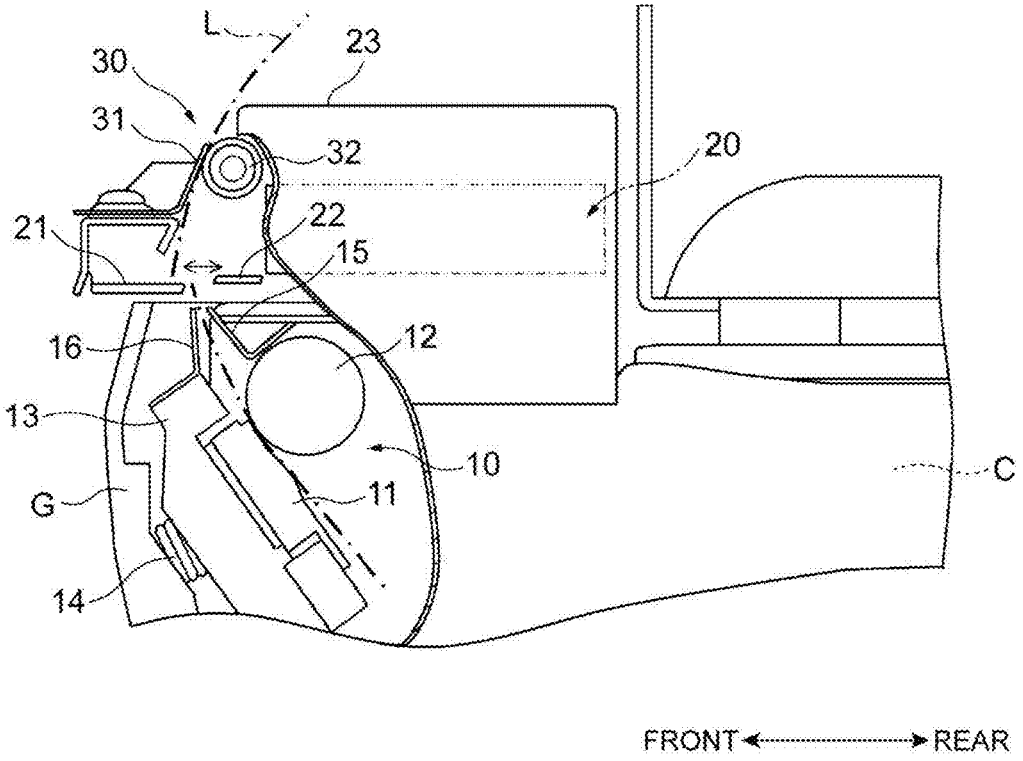
FIG. 3 is a cross-sectional view of a principal part of a print unit of the label printer.

First, an embodiment of an electronic balance equipped with a label printer according to the present invention will be described with reference to FIGS. 1 to 4. The technical scope of the present invention is not limited by the following embodiment. Dimensions and ratios of the drawings do not necessarily accord with the description. Note that, in the present specification, for convenience of description, description will be given based on an arrangement in which a side where a clerk-side display unit D1 is arranged is the "front", a side opposite to the side where the clerk-side display unit D1 is arranged is the "rear", a left-hand side of when looking at an electronic balance 100 from the front is the "left", and a right-hand side of when looking at the electronic balance 100 from the front side is the "right", as illustrated in FIGS. 1 to 3. However, this arrangement does not limit the configuration of the present invention.

As illustrated in FIGS. 1 to 4, the electronic balance 100 with a printer includes a main body case B, a label printer P, a measuring unit W, a control unit C, and a power source unit (not illustrated). The label printer P is incorporated in the main body case B. The measuring unit W is installed on an upper surface of the main body case B. The control unit C is incorporated in the main body case B, and controls the label printer P and the measuring unit W (refer to FIG. 4). The power source unit is similarly incorporated in the main body case B, and supplies power to the label printer P and the control unit C. The electronic balance 100 with the printer is also provided with a touch panel clerk-side display unit D1 and fixed keys D2 on the front side of the main body case B where a clerk operates the electronic balance 100, and provided with a customer-side display unit D3 on the rear side thereof.

The label printer P is housed on the right side in the main body case B. A swing door G is provided at the front of the main body case B. A case for the clerk-side display unit D1 provided in front of the swing door G is flipped upward, whereby the swing door G can be opened downward as illustrated in FIG. 2. After the swing door G is opened, a cassette CA can be taken out from the inside. A handle is attached to the front of the cassette CA. The handle is pulled forward, and the cassette CA can be pulled out of the main body case B.

The label printer P includes the cassette CA, a platen roller 12, a print head 11, a cutter unit 20, and a temporary adhesion unit 30. The cassette CA houses a label roll LR. The platen roller 12 is provided on the upper part of the tip end of the cassette CA. The print head 11 is provided on the rear surface of the swing door G. The cutter unit 20 is provided on the upper part of the anterior end of the main body case B.

The temporary adhesion unit 30 is provided in the vicinity of the cutter unit 20. On a side wall CA1 on the left side of the cassette CA, a roll support portion R is supported in a cantilever state as illustrated in FIG. 2. The label roll LR including a belt-like linerless label LB wound around a paper tube is mounted to the roll support portion R. The linerless label LB pulled out of the label roll LR gets under a guide roller GR to be passed on to the platen roller 12 on the upper part of the tip end of the cassette CA. The guide roller GR is attached to the side wall CA1 of the cassette CA in a cantilever state.

The linerless label LB is configured in such a manner that an adhesive is stacked on the rear surface of a sheet that is a base material, a heat sensitizer that develops a color by heat is stacked on the front surface of the base material, and a silicon resin as a release agent is applied on the heat sensitizer. The label roll LR is obtained such that the linerless label LB is wound around the paper tube with the rear surface of the linerless label LB facing the inside. The label roll LB is mounted to the roll support portion R so that the rear surface of the label roll LR comes in contact with the platen roller 12.

An identification code for identifying whether the mounted label roll LR is a liner label or the linerless label LB is provided at the rear of the cassette CA. Once the cassette CA is housed in the main body case B, the identification code is read by a reading unit. The reading unit notifies the control unit C of the identification code, that is, the type of the mounted label roll LR.

The print head 11 provided on the rear surface of the swing door G is configured from a thermal-type print head. A heat generation line of the print head 11 is positioned to come in contact with the platen roller 12 of the housed cassette CA when the swing door G is closed.

FIG. 3 is a cross-sectional view illustrating a principal part of a print unit 10 having the print head 11 and the platen roller 12. In this drawing, a support frame 13 is attached to the rear surface of the swing door G to approach/separate from the swing door G via a hinge (not illustrated). The print head 11 is fixed to the inside of the support frame 13. A spring 14 that presses the print head 11 against the platen roller 12 when the swing door G is closed is provided between the support frame 13 and the swing door G.

The platen roller 12 is attached to the upper part of the tip end of the cassette CA. A first guide plate 15 that restricts a moving path of a printed label L (linerless label LB) subjected to the printing is attached above the platen roller 12. The first guide plate 15 is arranged on the downstream side of the platen roller 12 in a feeding direction of the printed label L (linerless label LB). As illustrated in FIG. 2, a gear mechanism that drives the platen roller 12 is incorporated in the side wall CA1 of the cassette CA. When the cassette CA is mounted in the main body case B, the gear mechanism is connected to a drive motor within the main body case B, and the platen roller 12 is rotated.

In addition, a second guide plate 16 that restricts the moving path of the printed label L is arranged at the tip end portion of the support frame 13 adjacent to the swing door G. The first guide plate 15 and the second guide plate 16 are arranged to face each other (face each other in the form of an open-ended triangle) to be gradually narrowed in the direction of feeding the printed label L (linerless label LB) when the swing door G is closed. The printed label L (linerless label LB) is fed through the tip end portion where a gap between the first guide plate 15 and the second guide plate 16 becomes narrow.

Above the guide plates 15 and 16 and the platen roller 12, the cutter unit (cutter) 20 including a fixed blade 21 and a movable blade 22 is attached on the main body case B. In the cutter unit 20, the movable blade 22 is connected to a crank mechanism inside the cutter unit 20, and reciprocates between the crank mechanism and the fixed blade 21 at a high speed in a horizontal direction.

A space between the fixed blade 21 and the movable blade 22 is arranged to vertically face the gap between the pair of guide plates 15 and 16. The temporary adhesion unit 30 is arranged above the space between the fixed blade 21 and the movable blade 22.

The temporary adhesion unit 30 has a free roller 32 and a pressing member 31 that slightly presses the printed label L against the surface of the free roller 32. A rotatable roller having an uneven peripheral surface is used as the free roller 32 in order to decrease a contact area with a sticking surface of the printed label L. The pressing member 31 is formed of a thin resin plate, and slightly presses the issued printed label L against the free roller 32. A gap between the temporary adhesion unit 30 and the fixed blade 21 is set to such a distance that the front end portion of the issued printed label L can be sufficiently held. In the present embodiment, the free roller 32 and the pressing member 31 are fixed to a cover case 23 that covers the cutter unit 20. However, the temporary adhesion unit 30 may be formed into a unit, so that the unit can approach/separate from the fixed blade 21.

The measuring unit W includes a load cell, a signal processing circuit, a communication module, and a battery unit. The load cell has a well-known configuration for converting mechanical distortion into an electrical signal. The signal processing circuit amplifies the electrical signal output from the load cell and converts the amplified signal into a digital signal. The communication module transmits the digital signal to the control unit C in the main body case B by wireless means. The battery unit supplies power to these components. In the main body case B, a communication module, the control unit C, the label printer P, and the power source unit are housed. The communication module receives the digital signal transmitted from the measuring unit W. The control unit C converts the received digital signal into mass, calculates a price by multiplying the mass by a set unit price per unit mass, and displays the calculated price on the clerk-side display unit D1 and the customer-side display unit D3. The power source unit supplies power to these components. In the configuration of the present embodiment, a weight signal is transmitted from the measuring unit W to the control unit C by wireless means. However, the signal may be transmitted by wired means instead.

The clerk-side display unit D1 is a touch panel liquid crystal display, on which a necessary operation screen is displayed under the control of the control unit C. The fixed keys D2 include a unit price key, a fixed price key, a tare key, and a call key D21 for balancing and a print key D22 for giving an instruction to issue the printed label L. These keys are arranged together with numerical keys. The customer-side display unit D3 (refer to FIG. 4) is a liquid crystal display, on which the weight, the price, and an advertisement message concerning a commodity are displayed.

Figure 4:
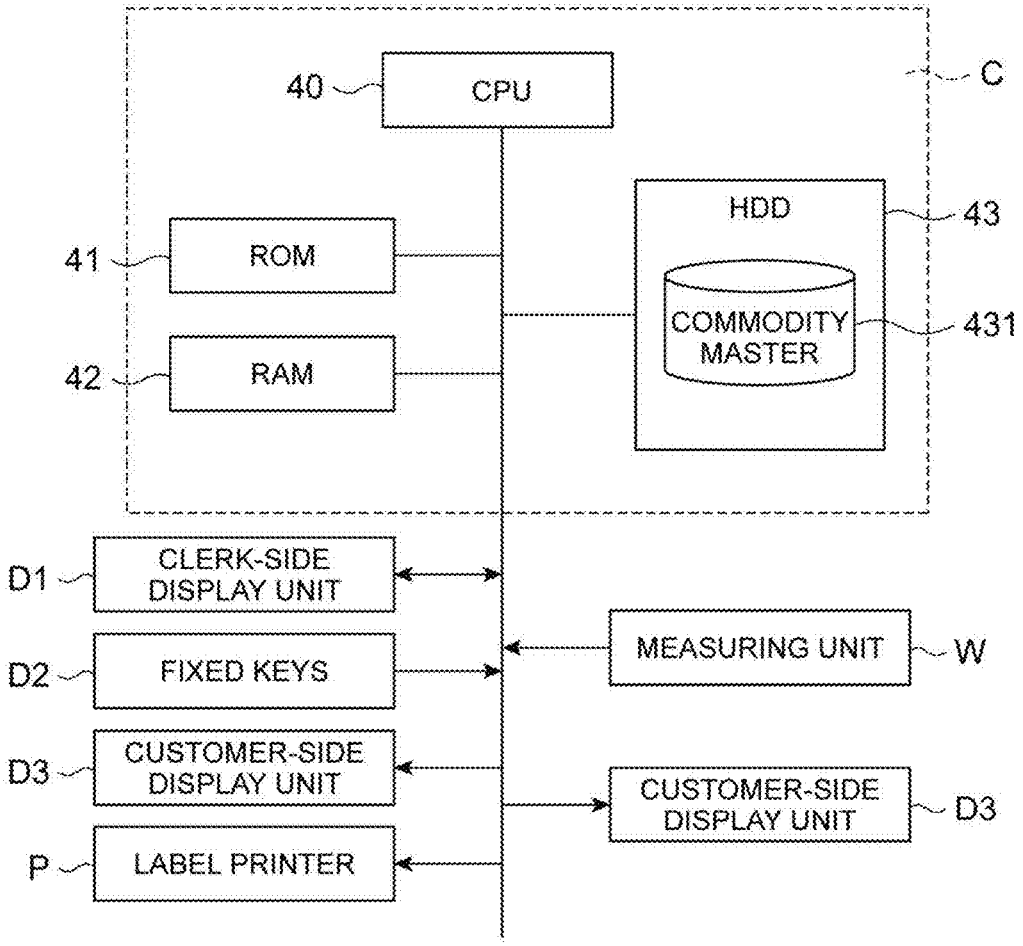
FIG. 4 is a block diagram of a schematic configuration of the electronic balance equipped with the label printer.
Figure 5:
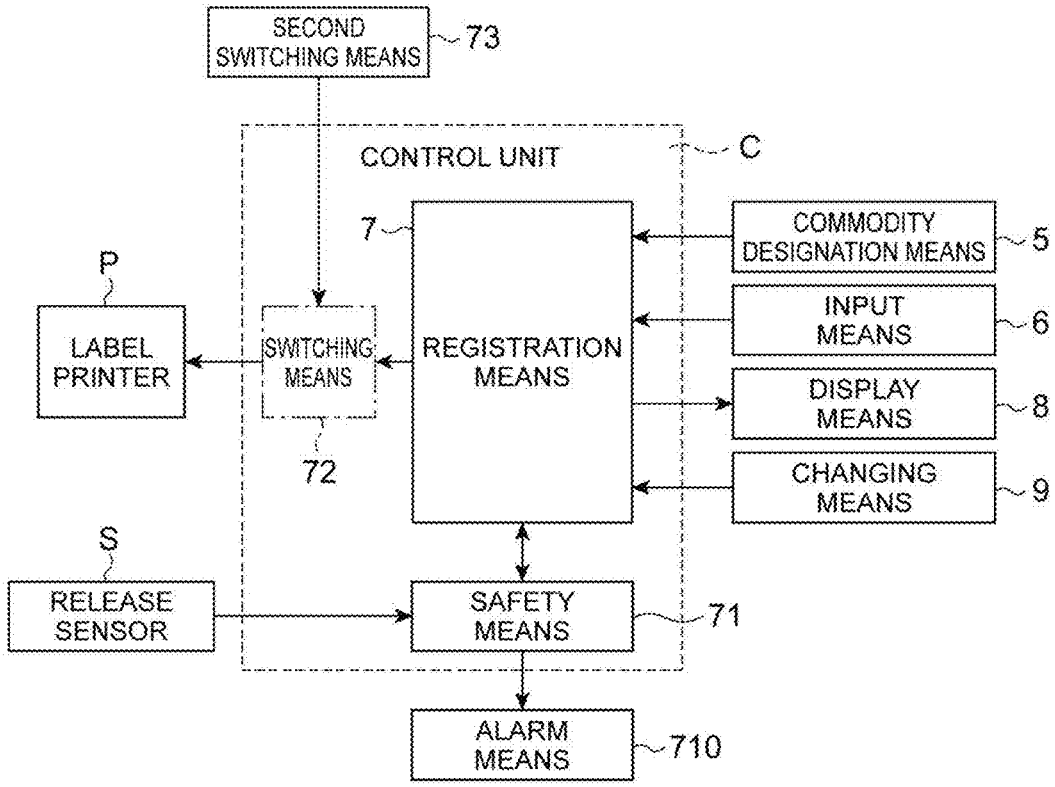
FIG. 5 is a functional block diagram of the label printer.

FIG. 4 is a block diagram illustrating the configuration of the electronic balance 100 with the printer. FIG. 5 is a block diagram illustrating the functions that are executed by the label printer P. In FIG. 4, the control unit C includes a CPU 40, a ROM 41, a RANI 42, and a hard disc drive (HDD) 43. The control unit C is electrically connected to the measuring unit W, the clerk-side display unit D1, the fixed keys D2, the customer-side display unit D3, and the label printer P.

A control program for the electronic balance 100 and the label printer P is stored in the ROM 41. The control program is read and executed by the CPU 40, whereby various functions of the label printer P to be described later as well as the function of the balance are realized. In the RAM 42, for example, reservation registration data for issuing the printed label L, a log file of the issued label printer L, print information to be output to the label printer P, and the like are stored. A commodity master 431 illustrated in FIG. 6 is stored in the HDD 43.

In a case where the electronic balance 100 is used as the balance, a commodity designation means 5 (refer to FIG. 5) displayed on the clerk-side display unit D1 is operated. Alternatively, the commodity number of the commodity is input using the numerical keys of FIG. 1, and the call key D21 is operated. Then, the commodity is placed on the measuring unit W, and the weight, price, and name of the commodity are displayed on the clerk-side display unit D1 and the customer-side display unit D3.

Next, the print key D22 is operated, and the platen roller 12 is reversely rotated to put the front end edge of the linerless label LB back to the position of the heat generation line of the print head 11 while retracting the linerless label LB fed to the cutting position. Next, the platen roller 12 is rotated in a forward direction to print the weight, price, commodity information, and the like in a predetermined format while feeding the linerless label LB. Meanwhile, the fed linerless label LB moves upward by passing through the gap between the pair of guide plates 15 and 16 and further passing through the space between the fixed blade 21 and the movable blade 22. Even after the printing is finished, the platen roller 12 is further rotated until the rear end edge of the linerless label LB as the printed label L arrives at the cutting position. Consequently, the front end portion of the linerless label LB enters a gap between the pressing member 31 and the free roller 32, whereby the front end portion of the linerless label LB is pushed by the pressing member 31 and inclined toward the measuring unit W.

As soon as the platen roller 12 stops feeding the linerless label LB, the cutter unit 20 is operated, so that the movable blade 22 cuts the linerless label LB along the boundary between the preceding and subsequent printed labels L. Then, since the rear end portion of the printed label L is pushed by the movable blade 22, and the front end portion of the printed label L is inclined toward the measuring unit W, the rear end portion of the printed label L is moved in the opposite direction, that is, toward the clerk-side display unit D1, and stopped. Consequently, the sticking surface of the cut printed label L is moved to a position where the sticking surface does not hinder the progress of the front end portion of the subsequent linerless label LB. Once the printed label L for the measured commodity is issued in this manner, an operator takes the printed label L stopped at the temporary adhesion unit 30 to affix it to the commodity. The above-mentioned operation of each component is realized when the CPU 40 of the control unit C reads the control program from the ROM 41 and executes it.

FIG. 5 is a diagram illustrating functional blocks that are realized when the control unit C executes the control program in a case where, for example, the printed labels L such as fixed price labels are continuously issued by the label printer P.

Figure 7:
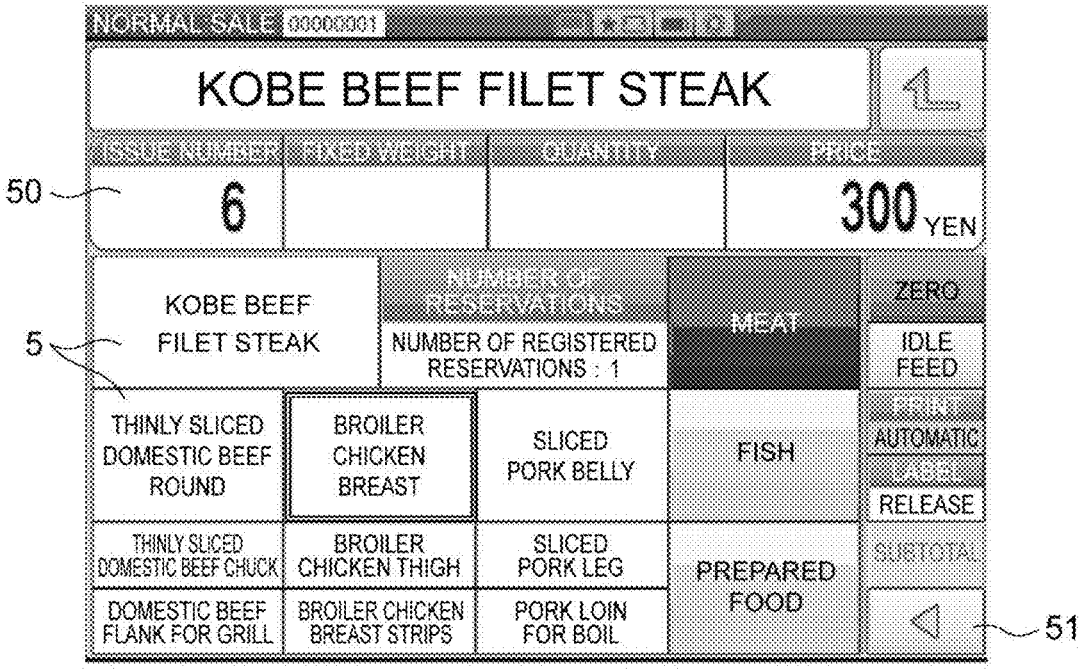
FIG. 7 is an example of an operation screen for issuing a fixed price label.

The commodity designation means 5 illustrated in FIG. 5 is a means for designating a commodity for which the printed label L is to be issued. For example, as illustrated in FIG. 7, the commodity designation means 5 is configured as sectional display fields in which commodity names such as "thinly sliced domestic beef round" and "broiler chicken breast" are displayed. Once any of the sectional display fields is touched, the touched sectional display field is detected, and the commodity in the sectional display field is designated. Alternatively, the commodity can be designated in such a manner that the commodity number is input using the numerical keys illustrated in FIG. 1, and the call key D21 is operated. Therefore, the numerical keys and the call key D21 are included in the commodity designation means 5. The commodity numbers are registered with the commodity master 431 illustrated in FIG. 6. Once the number is input, the corresponding commodity information is read from the commodity master 431.

An input means 6 is a means for inputting the number of printed labels L to be issued for the designated commodity. For example, the input means 6 is the numerical keys illustrated in FIG. 1. FIG. 7 is a diagram illustrating an example of the operation screen displayed on the clerk-side display unit D1. A set number of printed labels L are issued using this screen in such a manner, for example, that "Kobe beef filet steak" is touched as the commodity designation means 5, and, for example, "10" is input through the numerical keys as the number of printed labels L to be issued. Consequently, the control unit C registers "10" as the number of printed labels L to be issued for the designated "Kobe beef filet steak". The commodity designation means 5 illustrated in FIG. 7 includes a plurality of sectional display fields in which the commodity names are displayed. The commodity names such as the "thinly sliced domestic beef round" and the "broiler chicken breast" displayed in the respective display fields are switched with a touch on a "meat" key, a "fish" key, and a "prepared food" key. It is possible to display the next group of commodities included in the same category simply by pressing a page switch key 51 at the lower right corner. Consequently, the next group of commodities included in the "meat" category is displayed as the sectional display fields. Instead of the touch on the "Kobe beef filet steak", a similar screen is displayed in such a manner that the call key D21 illustrated in FIG. 1 is operated after the corresponding commodity number registered with the commodity master 431 illustrated in FIG. 6, that is, "000001", is input.

Next, when the print key D22 illustrated in FIG. 1 is pressed, the leading printed label L is issued first in the above-mentioned manner. Subsequently, the linerless label LB detached from the leading printed label L is pulled back to the print position by rotation in the reverse direction of the platen roller 12, and the linerless label LB is printed while being fed by the rotation in the forward direction again. Then, when the boundary position between the preceding printed label L and the subsequent printed label L arrives at the cutting position, the feeding of the linerless label. LB is stopped at that point. The cutter unit 20 is then operated to cut the linerless label LB as the printed label L. In this manner, the linerless label LB is once pulled back, and is then fed and printed. Every time a single printed label L is issued, the number of printed labels L to be issued "10" set in advance is counted down, and the value is sequentially displayed in a display field 50 for the number of printed labels L to be issued.

Meanwhile, the cut printed label L is held by the temporary adhesion unit 30 in a forward inclined posture as illustrated in FIG. 3. Since the linerless label LB that serves as the subsequent printed label L is subsequently fed, the linerless label LB and the printed label L are joined together once the front end of the linerless label LB comes in contact with the sticking surface of the preceding printed label L. As the linerless label LB is fed further continuously, the preceding printed label L passes through the temporary adhesion unit 30 and hangs down over the measuring unit W accordingly. When the preceding printed label L hangs down over the measuring unit W, the rear end portion of the printed label L held by the temporary adhesion unit 30 is inclined toward the customer-side display unit D3 more and more, whereby the printed label L is joined to the linerless label LB more reliably. The above-described operation is repeated, whereby the linerless label LB is cut into a series of printed labels L, and the printed labels L are caused to adhere to the rear end portions of the preceding printed labels L one after another, and continuously issued in a linked-sheet shape. Needless to say, the above-described operation is realized when the CPU 40 of the control unit C reads and executes the control program in the above-mentioned manner.

In addition, a reservation for issuing the printed label L for the next commodity can be made immediately after the issuance operation for the first printed label L or during the issuance of the subsequent printed label L. More specifically, in the above-mentioned manner, the next commodity is designated by the commodity designation means 5, the number of printed labels L to be issued is input by the input means 6 (numerical keys), and the print key D22 is operated. For example, as illustrated in FIG. 7, when the "broiler chicken breast" is designated as the next commodity, the sectional display field for the designated commodity is highlighted. Then, the number of printed labels L to be issued is input by the input means 6, and the print key D22 is operated, whereby the designated commodity and the number of printed labels L to be issued are registered with the RAM 42 by a registration means 7. Furthermore, the highlight on the sectional display field is turned off, the background color in a reservation number display field 52 is changed, and the number of reservations is displayed in the reservation number display field 52 (refer to FIG. 8). The screen illustrated in FIG. 7 indicates that the "broiler chicken breast" is highlighted as the second designated commodity, and the "broiler chicken breast" is selected as the next commodity while the original number of printed labels L to be issued is reduced from "10" to "6".

In this manner, the designation of the next commodity, the input of the number of printed labels L to be issued for the next commodity, and the subsequent operation for the print key D22 are sequentially repeated during the issuance of the printed labels L. Consequently, the registration means 7 registers the designated commodity and the number of printed labels L to be issued with the RAM 42 in order of reservation even during the issuance of the printed labels L. The screen illustrated in FIG. 8 indicates that the issuance of the printed labels L for the initially set "Kobe beef filet steak" is finished, the "broiler chicken breast" that is the next reserved commodity is read, and the printed labels L for the "broiler chicken breast" are issued. The screen illustrated in FIG. 8 also indicates that reservations are made one after another in the above-mentioned manner during the issuance of the printed labels L, five reservations are registered in total, and the commodity "broiler chicken breast strips" out of the five registered reservations is the last to be reserved and registered.

Figure 8:
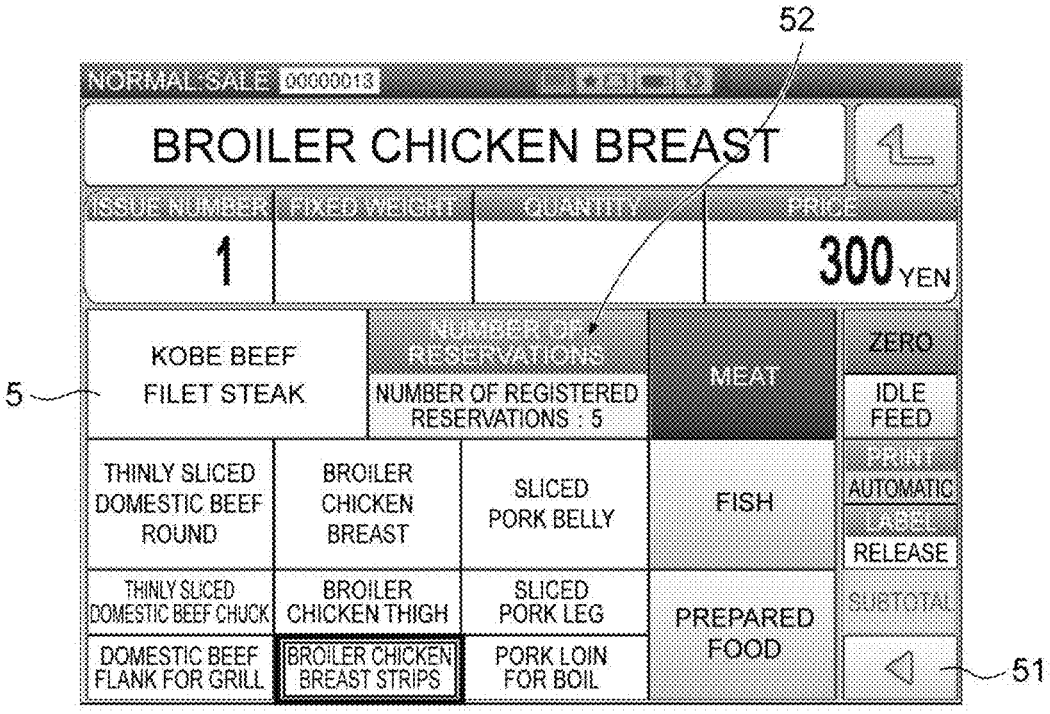
FIG. 8 is an example of the operation screen in which the issuance of the fixed price label is switched to the next commodity.
Figure 9:
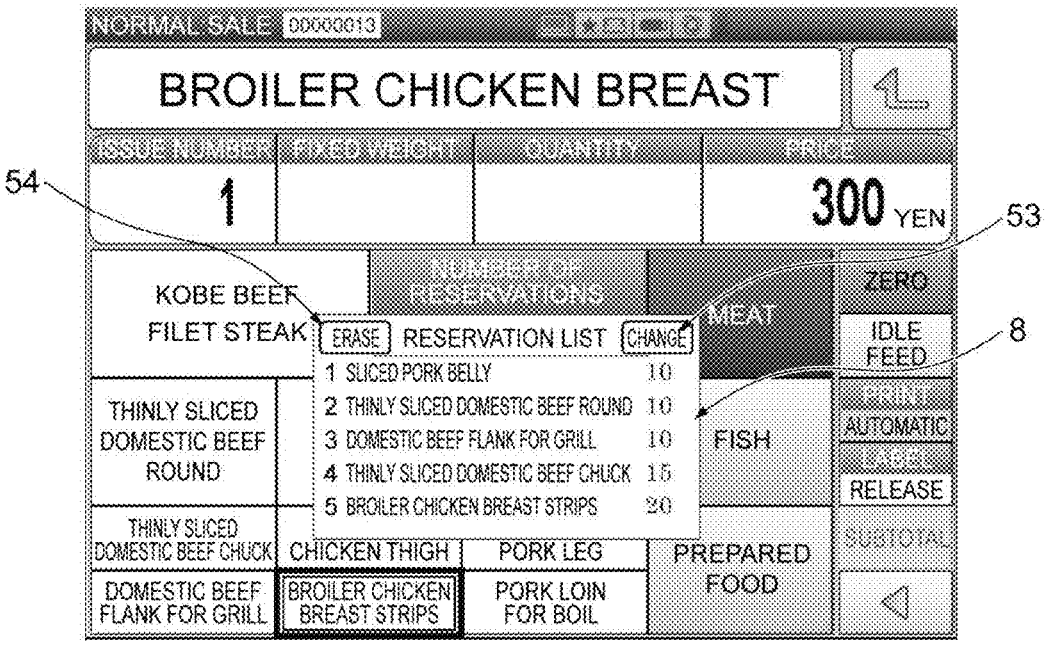
FIG. 9 is an example of the operation screen on which a reservation list is displayed.

After the above operation, the reservation number display field 52 illustrated in FIG. 8 is touched for confirmation of the registered reservation contents. Then, a display field (display means 8) appears as illustrated in FIG. 9 to display a reservation list. Consequently, the reservation list of the reserved commodities can be confirmed, whereby whether work order coincides with issuance order for the printed labels L can be confirmed. Alternatively, the display means 8 that displays the reservation list may be displayed when the mode is switched to a reservation registration mode. Still alternatively, a list of processed commodities for which the printed labels L have already been issued and a list of unprocessed commodities may be indicated with different colors and displayed on the display means 8.

A changing means 9 illustrated in FIG. 5 is a means for changing the issuance order for the printed labels L for the reserved commodities. For example, in the reservation list illustrated in FIG. 9, "sliced pork belly" scheduled to be processed next is touched, "2" is input through the numerical key, and a "change" key 53 is touched. Then, the "sliced pork belly" is moved down to the second line, and the "thinly sliced domestic beef round" on the second line is moved up to the first line. When an "erase" key 54 is operated after the reserved commodity in the reservation list is designated, the reservation for the designated commodity is canceled. Consequently, even when a mismatch occurs between the work order and the issuance order for the printed labels L, the issuance order is changed, the reserved commodity is erased, or a reservation for a new commodity is registered, whereby, for example, the top commodity in the issuance order can be replaced by the new commodity, and the mismatch between the work order and the issuance order for the printed labels L can be resolved.

In addition, a notification label such as a blank label or a label with a printed mark is registered with the registration means 7. When the issuance of a reserved number of labels is finished, and print information of the next reserved commodity is read, the notification label is issued and connected to the rear end portion of the preceding printed label L. Then, the print information of the next reserved commodity is read, and the printed label L for the next commodity is issued. In other words, after the issuance of a reserved number of printed labels is finished, and before the print information of the next reserved commodity is read, the registration means 7 reads information on the notification label such as a blank label or a label with a printed mark, and issues the notification label to connect it to the rear end portion of the preceding printed label L. Then, the registration means 7 reads the print information of the next reserved commodity, and issues the printed label L for the next commodity. Consequently, the notification label can be interposed between the preceding group of printed labels L and the subsequent group of printed labels L. Therefore, the operator can identify the boundary between the preceding group and the subsequent group, and remove the printed labels L collectively from a label issuing port on a group basis.

The label issuing port of the label printer P is provided with a release sensor (detection sensor) S that detects the issued printed label L as illustrated in FIGS. 1 and 2. The release sensor S detects the printed label L positioned at the label issuing port, and outputs a detection signal to a safety means 71. The safety means 71 counts the number of issued printed labels L every time the printed label L is issued. If the printed labels L exist at the label issuing port even after the count value reaches a predetermined number of printed labels L, the safety means 71 notifies the registration means 7 to stop issuing the next printed label L. At the same time, the safety means 71 operates an alarm means 710 to notify the operator to stop issuing the printed label L using sound and/or light. Consequently, the problem of continuously issuing long printed labels L that are likely to stick to a measuring tray can be avoided.

Since the length of a single printed label L to be issued varies in accordance with the print amount for each commodity, the safety means 71 may monitor the length of a single printed label L by counting the pulse for rotating the platen roller 12. Specifically, when the above-described count value reaches a value corresponding to the length of a single printed label L, the safety means 71 determines that the issuance of a single printed label L is finished, and counts the number of issued printed labels L. When the number of issued printed labels L is equal to or greater than a preset value, the safety means 71 temporarily stops issuing the printed label L. In response to the release sensor S detecting the absence of the printed label L at the label issuing port, the safety means 71 clears the count value, i.e., the number of printed labels L at the label issuing port, and instructs the registration means 7 to restart to issue the printed label L. Needless to say, the above-described operational control of the safety means 71 is realized when the CPU 40 of the control unit C reads and executes the control program in the above-mentioned manner.

In the above embodiment, the number of issued printed labels L is counted. Alternatively, the drive pulse for rotating the platen roller 12 is counted in consideration of the feeding in the forward direction and the reverse direction, whereby the length of the printed labels L fed to the label issuing port can be calculated. In this case, since the feed length of the region where the preceding and subsequent printed labels L partially overlap each other is fixed, the length of the overlapped part is subtracted from the length of an issued number of printed labels L, whereby the length of the printed labels L fed to the label issuing port can be obtained.

The detecting function of the release sensor S can be turned on or off when a "release" key 55 displayed in a columnar field at the right corner illustrated in FIGS. 7 to 9 is operated. Since the release sensor S is arranged at such a position as to face the printed label L at the label issuing port, in a case where a liner label is used, the release sensor S serves as a sensor for detecting whether the issued printed label L is released from the liner.

Examples of the information printed on the printed label L include basic information such as the name and price of the commodity and additional information such as raw materials, condiments, and additives used in the commodity and nutrients. These items of information are printed on a single printed label L if the amount of print data to be printed on the printed label L is small. If the amount of print data is large, the basic information may be printed on a name label (printed label), and the additional information may be separately printed on an auxiliary label (printed label). Therefore, the control unit C is provided with a switching means 72 for switching between a two-label issuance mode in which the name label including the name of the reserved commodity or the like and the auxiliary label including additives for the commodity or the like are separately issued and a single-label issuance mode in which the name label and the auxiliary label are combined and issued as a single printed label L instead of being separately issued. The switching means 72 is also realized when the control program is executed.

In a case where the name label and the auxiliary label are separately issued as the two printed labels L, the following two methods can be used depending on the amount of work of affixing the printed labels L. First, the name labels and the auxiliary labels are alternately connected and issued as the printed labels L. Second, a reserved number of name labels are issued first, and a reserved number of auxiliary labels are issued next. A second switching means 73 is configured to select whether the same labels are collectively issued or different labels are issued in order, that is, the name labels and the auxiliary labels are alternately issued. During a multiple-label issuance mode, the second switching means 73 is displayed on the clerk-side display unit D1 and operated, whereby whether the "collective issuance" is performed can be selected. In a case where the two labels are separately issued, common items such as the address and name of the store are printed on each label. Therefore, a format for the name label and a format for the auxiliary label are prepared as label formats, and a field for the address and name of the store is provided in each format. Thus, in a case where these formats are connected, combined, and issued as a single label, the field for the address and name of the store is removed from the name label, and the leading print field of the auxiliary label is shifted to the position of the removed field. Consequently, the length of the issued labels can be set to a required minimum length.

In the above embodiment, the two printed labels L are separately issued. For some commodities, however, three or more printed labels L are separately issued. For example, three or more printed labels L are separately issued in a case where a cooking method (recipe) for the commodity is printed on a label, and the label is affixed to the commodity together with the other labels. In order to deal with such a case, the switching means 72 is configured to be capable of issuing a single printed label L, two separate printed labels L, or three separate printed labels L in accordance with the amount of print data for printing the printed label L for each commodity. For example, in a case where additives, a recipe, and the like as well as the commodity information such as the name and price of the commodity are registered as the print data, the switching means 72 separately issues the name label, an additive label, and a recipe label. In this case, when the "collective issuance" is selected by the second switching means 73, a reserved number of name labels are issued first, a reserved number of additive labels are issued next, and a reserved number of recipe labels are finally issued.

The present invention is not limited to the embodiment of the present invention described above, and another embodiment can also be employed.

Figure 10:
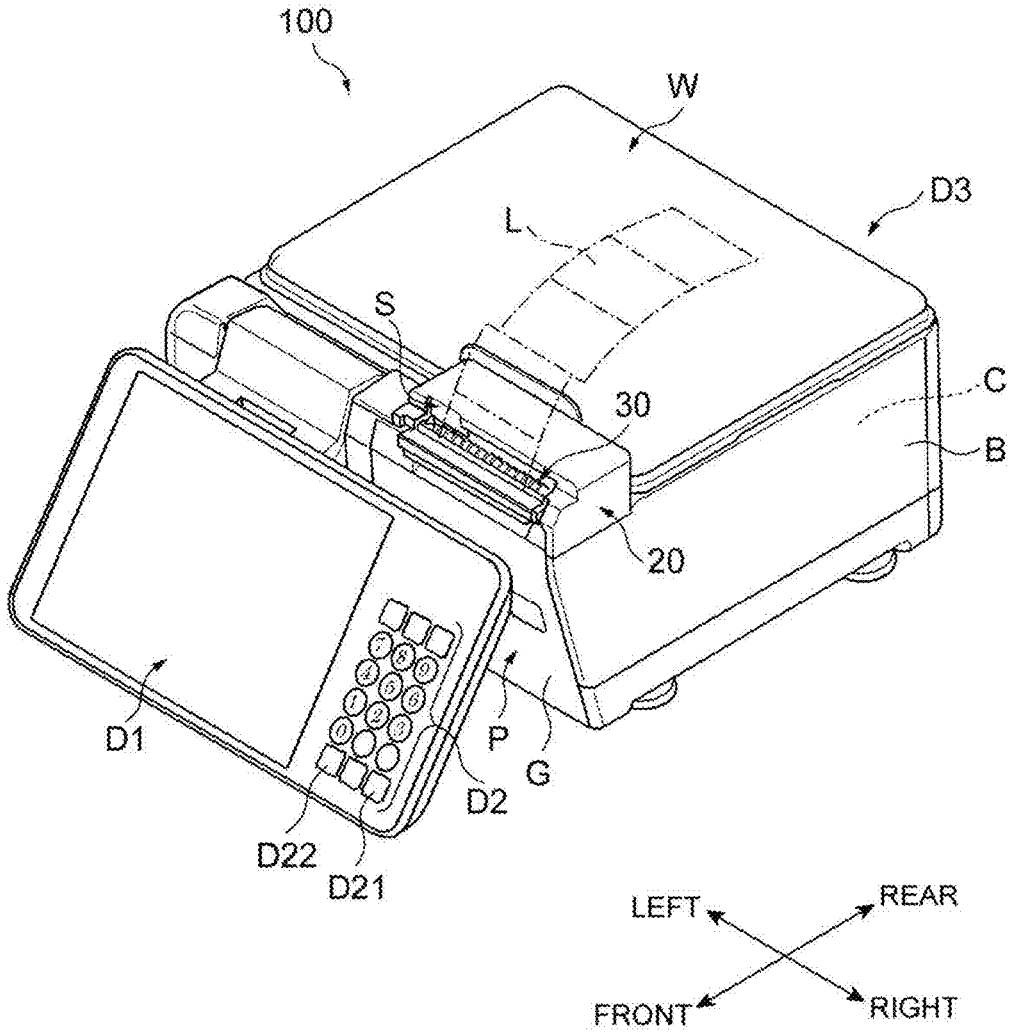
FIG. 10 is an external perspective view of an electronic balance equipped with a label printer according to a modification.
Figure 11:
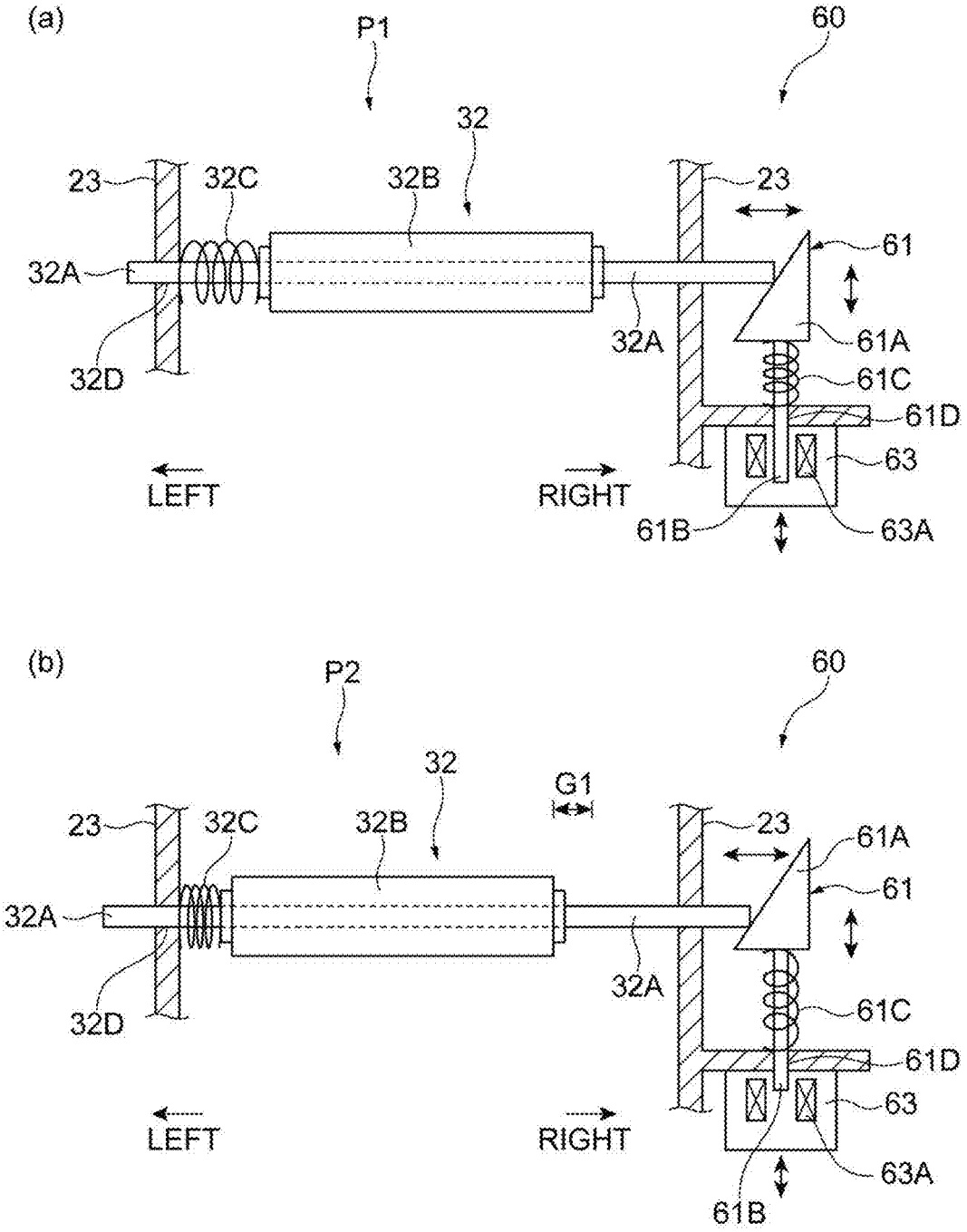
FIG. 11(*a*) is a diagram illustrating a schematic configuration of a moving mechanism included in the label printer of FIG. 10, and illustrating a free roller positioned in a first position.

As illustrated in FIG. 10, in addition to the configuration of the label printer P according to the above embodiment, a moving mechanism 60 may further be provided so as to be capable of switching the position of the free roller (temporary adhesion unit) 32 with respect to the platen roller (print unit) 12 in a direction (left-right direction illustrated in FIGS. 11(*a*) and 11(*b*)) approximately perpendicular to the feeding direction of the printed label L and to a direction perpendicular to a print surface of the printed label L. Specifically, as illustrated in FIGS. 11(*a*) and 11(*b*), the moving mechanism 60 has a pushing portion 61 and a solenoid 63.

First, the free roller 32 will be described. As illustrated in FIGS. 11(*a*) and 11(*b*), the free roller 32 has an axis portion 32A, a roller portion 32B, and a spring 32C. The roller portion 32B is rotatably provided to the axis portion 32A. Both ends of the axis portion 32A are supported by the cover case 23 that covers the cutter unit 20. Between one support portion 32D and the roller portion 32B, of support portions between the cover case 23 and the axis portion 32A, the spring 32C that biases the free roller 32 in a direction away from the support portion 32D is arranged. With this configuration, even if force is applied to the axis portion 32A toward the one support portion 32D, and the free roller 32 is moved toward the one support portion 32D, the free roller 32 can be restored to a former position before the application of the force when the force is removed.

A peripheral surface of the free roller 32 is formed in an uneven manner in order to decrease a contact area with the sticking surface of the printed label L. In the present embodiment, the pressing member 31 and the free roller 32 are fixed to the cover case 23 that covers the cutter unit 20. However, the temporary adhesion unit 30 may be formed into a unit, so that the unit can approach/separate from the cutter unit 20.

The pushing portion 61 has a contact portion 61A, an axis portion 61B, and a spring 61C. The contact portion 61A is in contact with the other end of the axis portion 32A. One end of the axis portion 61B is connected to the contact portion 61A, and the other end is connected to the solenoid 63 via a support portion 61D. In the axis portion 61B, between the contact portion 61A and the support portion 61D, the spring 61C that biases the contact portion 61A in a direction away from the support portion 61D is arranged.

The solenoid 63 is a drive unit for the pushing portion 61. The solenoid 63 linearly drives the axis portion 61B when a coil 63A included in the solenoid 63 is energized. To be specific, the solenoid 63 drives the axis portion 61B in an up-down direction illustrated in FIGS. 11(*a*) and 11(*b*), and when the coil 63A is energized, the solenoid 63 moves the axis portion 61B downward.

When the coil 63A of the solenoid 63 is energized, the axis portion 61B is drawn downward, and the pushing portion 61 is moved downward. The axis portion 32A of the free roller 32, which is in contact with the pushing portion 61, is moved in the right direction along the contact portion 61A by biasing force of the spring 32C. That is, the free roller 32 is moved to a relatively-right first position P1, as illustrated in FIG. 11(*a*).

Meanwhile, when the energization to the coil 63A of the solenoid 63 is ceased, the action to draw the axis portion 61B downward is ceased, and the pushing portion 61 is moved upward by biasing force of the spring 61C. The axis portion 32A of the free roller 32, which is in contact with the pushing portion 61, is pushed in the left direction along the contact portion 61A. That is, the free roller 32 is moved to a relatively-left second position P2, as illustrated in FIG. 11(*b*). With such a configuration of the moving mechanism 60, the temporary adhesion unit 30 can be moved to the first position P1 and the second position P2 in a first direction (left-right direction illustrated in FIG. 11(*a*)) that is perpendicular to the feeding direction of the printed label L and to the direction perpendicular to the print surface of the printed label L.

The control unit C controls the moving mechanism 60 to switch the position of the free roller 32. The control unit C of the present embodiment may switch the position of the free roller 32 when the issuance of a number of printed labels L reserved by the registration means 7 is finished. Specifically, the position of the free roller 32 is alternately switched to the first position P1 (refer to FIG. 11(*a*)) and to the second position P2 (refer to FIG. 11(*b*)) every time the issuance of a number of printed labels L reserved by the registration means 7 is finished. The above control is performed in such a manner, for example, that the program stored in the ROM is loaded on the RAM and executed by the CPU.

According to the configuration of the present modification, the free roller 32 holding the printed label L is shifted in the left-right direction by a predetermined amount with respect to the platen roller 12 once the printing of the preceding group of printed labels L is finished. Consequently, the adjacent printed labels L included in the different groups can be shifted from each other. As a result, the operator can identify the boundary between the preceding group and the subsequent group, and remove the issued printed labels L collectively on a group basis.

Instead of the configuration of the moving mechanism 60 according to the above-mentioned modification, the label printer P may have a moving mechanism 160 configured as described below. For example, the free roller 32 in the temporary adhesion unit 30 may be configured to be movable in multi stages, instead of the two stages of the first position P1 and the second position P2. A configuration of the moving mechanism 160 for this case will be described using FIG. 12.

Figure 12:
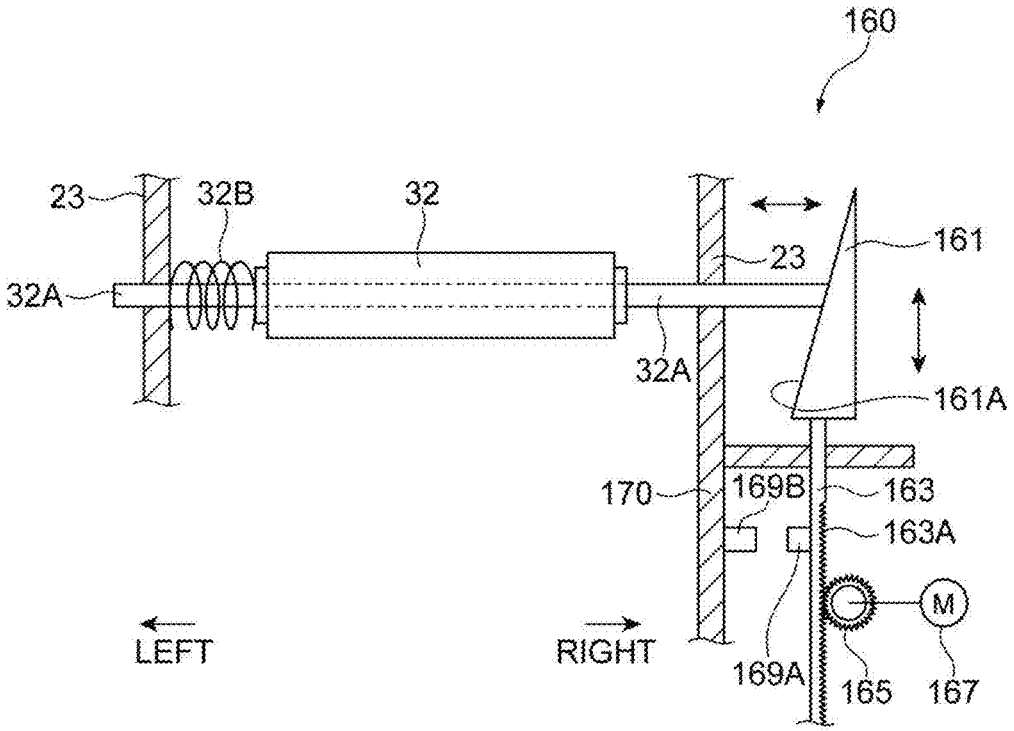
FIG. 12 is a diagram illustrating a schematic configuration of the moving mechanism included in the label printer of FIG. 10.

The moving mechanism 160 is similar to the moving mechanism 60 in that the position of the free roller 32 with respect to the platen roller 12 is relatively moved in the left-right direction. As illustrated in FIG. 12, the moving mechanism 160 has a pushing portion 161, a rack portion 163, a pinion portion 165, a motor 167, and a position acquisition unit 169. Note that the configuration of the free roller 32 is similar to that in the above-mentioned embodiment, and thus description is omitted.

The pushing portion 161 is in contact with the other end of the axis portion 32A. In the pushing portion 161, a contact surface 161A that is in contact with the axis portion 32A is inclined downward to the left, and pushes the axis portion 32A to the left following the movement of the pushing portion 161 in the up direction. The rack portion 163 is movably supported by a support portion 170. The rack portion 163 is a rod-like member with one end being connected to the pushing portion 161, and is integrally movable with the pushing portion 161. Teeth 163A are formed in the rack portion 163. The teeth 163A mesh with teeth of the pinion portion 165 driven and rotated by the motor 167. An example of the motor 167 includes a stepping motor. The rack portion 163 and the pinion portion 165 constitute a rack and pinion, and rotational force in the motor 167 is converted into the movement of the pushing portion 161 in the up-down direction.

The position acquisition unit 169 includes a detection plate 169A provided on the rack portion 163 and a sensor 169B provided on a support portion 170. A plurality of the sensors 169B may be arranged along a moving direction of the rack portion 163. When the sensor 169B detects the detection plate 169A, the position acquisition unit 169 acquires the position of the pushing portion 161 in the up-down direction with respect to the support portion 170.

With such a configuration of the moving mechanism 160, when the motor 167 is driven, and the rack portion 163 is moved downward, the pushing portion 161 is also moved downward. The axis portion 32A of the free roller 32, which is in contact with the pushing portion 161, is moved in the right direction along the contact surface 161A by biasing force of the spring 32C. That is, the free roller 32 is relatively moved to the right side. In contrast, when the rack portion 163 is moved upward, the pushing portion 161 is also moved upward. The axis portion 32A of the free roller 32, which is in contact with the pushing portion 161, is pushed in the left direction along the contact surface 161A. That is, the free roller 32 is relatively moved to the left side. The position of the rack portion 163 in the up-down direction can be acquired by the position acquisition unit 169. Accordingly, the position of the free roller 32 which is moved in the left-right direction can also be acquired in the left-right direction. With such a configuration of the moving mechanism 160, the free roller 32 is configured to be movable in multi stages in the left-right direction illustrated in FIG. 12 (first direction perpendicular to the feeding direction of the printed label L and to the direction perpendicular to the print surface of the printed label L (linerless label LB)).

According to the label printer P including the moving mechanism 160 having the above configuration, for example, the free roller 32 to which the printed label L adheres is shifted in the left-right direction by a predetermined amount with respect to the platen roller 12 every time the printed label L is issued, regardless of the group. Consequently, the printed labels L are stacked while being shifted in the left-right direction one by one, and the shift direction and/or shift amount in the adjacent printed labels L included in the different groups can be relatively increased. As a result, the operator can identify the boundary between the preceding group and the subsequent group, and remove the issued printed labels L collectively on a group basis.

In the above embodiment, the printed label L is fed upward. Alternatively, the printed label may be fed downward, for example. According to this configuration, the issued printed labels L hang down over the front side where the operator exists. Therefore, in a case where the electronic balance 100 with the printer is installed on a table, the issued printed labels can be prevented from coming in contact with the measuring unit W. Such a configuration can be obtained simply in such a manner that the print head 11 and the platen roller 12 are arranged upside down, the label roll LR is inversely mounted, and the linerless label LB is fed so that the print surface faces upward and the sticking surface faces downward.

Since the print contents and/or width of the linerless label LB for use are specified for each commodity, the feed length of a single printed label L can be grasped in advance from these items of information. Therefore, the feed length of the printed label L is registered with the commodity master 431 illustrated in FIG. 6 in association with each commodity, and the number and/or length of printed labels L at the label issuing port are calculated on the basis of the registered feed length of the printed label L. Alternatively, how many printed labels L are continuously issued or how long the printed labels L are continuously issued at the label issuing port to stick to the surroundings may be obtained in advance, and the obtained number or length of printed labels L may be registered in association with each commodity. Owing to this configuration, even when reservations for the number of printed labels L to be issued for various commodities are registered one after another, the number of printed labels L at the label issuing port can be restricted on the basis of the feed length of a single printed label L registered with the commodity master and the number and/or length of printed labels L above which the printed labels L stick to the surroundings.

If the type of read commodity is switched, the number and/or length of printed labels L allowed at the label issuing port are also changed. Therefore, in a case where the type of reserved commodity is switched, the issuance of the printed label L to be affixed to the next commodity may be stopped until the issued printed labels L are removed from the label issuing port. Consequently, the printed labels L having different print contents cannot be simultaneously present at the label issuing port, and the number and/or length of printed labels L held at the label issuing port can be easily calculated.

The above-described various embodiments and modifications may be combined without departing from the gist of the present invention.

REFERENCE SIGNS LIST

100 . . . Electronic balance
P . . . Label printer
5 . . . Commodity designation means (designation means)
6 . . . Input means
7 . . . Registration means
8 . . . Display means
9 . . . Changing means
10 . . . Print unit
20 . . . Cutter unit
30 . . . Temporary adhesion unit
60, 160 . . . Moving mechanism
71 . . . Safety means
72 . . . Switching means
73 . . . Second switching means
C . . . Control unit
S . . . Release sensor (detection sensor)
L . . . Printed label
LB . . . Linerless label

The invention claimed is:

1. A label printer configured to sequentially issue a reserved number of printed labels on which information on a reserved commodity is printed, the label printer comprising:

a designation unit configured to designate a commodity;

an input unit configured to input the number of printed labels to be issued on which information on the commodity designated by the designation unit is printed; and a registration unit configured to receive, while the printed labels are issued, designation of the commodity by the designation unit and input of the number of printed labels to be issued by the input unit, and register a reservation.

2. The label printer according to claim 1, further comprising:

a display unit configured to display a list of reservation contents registered by the registration unit.

3. The label printer according to claim 1, further comprising:

a changing unit configured to change issuance order for printed labels for commodities reserved by the registration unit.

4. The label printer according to claim 1, further comprising:

a print unit configured to print a linerless label while feeding the linerless label wound in a roll shape;

a cutter arranged on a downstream side of the print unit to cut the printed linerless label to a predetermined length; and a temporary adhesion unit configured to hold from front and rear sides the printed label, being the printed linerless label cut by the cutter, and to adhere a rear end portion of the printed label to a front end portion of a subsequent printed label fed subsequent to the printed label.

5. The label printer according to claim 1, comprising:

a print unit configured to print a linerless label while feeding the linerless label wound in a roll shape;

a cutter arranged on a downstream side of the print unit to cut the printed linerless label to a predetermined length; and a temporary adhesion unit configured to hold from front and rear sides the printed label, being the printed linerless label cut by the cutter, and to adhere an upstream end portion in a feeding direction of the printed label to a downstream end portion in a feeding direction of a subsequent printed label fed subsequent to the printed label.

6. The label printer according to claim 4, wherein when issuance of a number of printed labels reserved by the registration unit is finished, the print unit prints a notification label indicating a boundary between the printed label reserved by the registration unit and the printed label to be subsequently printed.

7. The label printer according to claim 4, further comprising:

a switching mechanism capable of switching a position of the temporary adhesion unit with respect to the print unit in a direction approximately perpendicular to the feeding direction of the printed label and to a direction perpendicular to a print surface of the printed label, wherein the switching mechanism switches the position of the temporary adhesion unit when issuance of a number of printed labels reserved by the registration unit is finished.

8. The label printer according to claim 5, wherein when issuance of a number of printed labels reserved by the registration unit is finished, the print unit prints a notification label indicating a boundary between the printed label reserved by the registration unit and the printed label to be subsequently printed.

9. The label printer according to claim 5, further comprising:

a switching mechanism capable of switching a position of the temporary adhesion unit with respect to the print unit in a direction approximately perpendicular to the feeding direction of the printed label and to a direction perpendicular to a print surface of the printed label, wherein the switching mechanism switches the position of the temporary adhesion unit when issuance of a number of printed labels reserved by the registration unit is finished.

10. A label printer comprising:

a print unit configured to print a linerless label while feeding the linerless label wound in a roll shape;

a cutter arranged on a downstream side of the print unit to cut the printed linerless label to a predetermined length;

a temporary adhesion unit configured to hold from front and rear sides a printed label, being the printed linerless label cut by the cutter, and to adhere a rear end portion of the printed label to a front end portion of a subsequent printed label fed subsequent to the printed label; and a control unit configured to receive a setting for an upper limit of the number or length of printed labels that are issued to be linked to each other in a front-rear direction, and stop issuance of the printed label when the number or length of printed labels reaches the upper limit.

11. The label printer according to claim 10, further comprising:

a detection sensor configured to detect presence or absence of the issued printed label at a label issuing port, wherein the control unit stops issuance of the next printed label if the printed label is detected by the detection sensor after the number or length of the printed labels reaches a predetermined number or predetermined length at the label issuing port.

12. The label printer according to claim 11, wherein the control unit proceeds to issue the next printed label if removal of the printed label at the label issuing port is detected by the detection sensor before the number or length of the printed labels at the label issuing port reaches the predetermined number or predetermined length.

13. The label printer according to claim 11, wherein the control unit obtains the number or length of the printed labels at the label issuing port every time the printed label is issued.

14. The label printer according to claim 13, wherein when the control unit determines removal of the printed label from the label issuing port based on a detection signal provided by the detection sensor, the control unit clears the number or length of the printed labels at the label issuing port obtained in advance.

15. The label printer according to claim 14, wherein when print contents of the printed label to be subsequently issued are different from print contents of the printed label most recently issued, the control unit stops issuance of the printed label to be subsequently issued until removal of the printed label at the label issuing port is no longer detected by the detection sensor.

16. The label printer according to claim 10, further comprising:

a detection sensor configured to detect presence or absence of the issued printed label at a label issuing port, wherein the control unit stops issuance of the next printed label if the printed label is detected by the detection sensor after the number or length of the printed labels reaches a predetermined number or predetermined length at the label issuing port.

17. The label printer according to claim 16, wherein the control unit proceeds to issue the next printed label if removal of the printed label at the label issuing port is detected by the detection sensor before the number or length of the printed labels at the label issuing port reaches the predetermined number or predetermined length.

18. The label printer according to claim 17, wherein the control unit obtains the number or length of the printed labels at the label issuing port every time the printed label is issued.

19. The label printer according to claim 18, wherein when the control unit determines removal of the printed label from the label issuing port based on a detection signal provided by the detection sensor, the control unit clears the number or length of the printed labels at the label issuing port obtained in advance.

20. The label printer according to claim 19, wherein when print contents of the printed label to be subsequently issued are different from print contents of the printed label most recently issued, the control unit stops issuance of the printed label to be subsequently issued until removal of the printed label at the label issuing port is no longer detected by the detection sensor.

21. A label printer comprising:

a print unit configured to print a linerless label while feeding the linerless label wound in a roll shape;

a cutter arranged on a downstream side of the print unit to cut the printed linerless label to a predetermined length;

a temporary adhesion unit configured to hold from front and rear sides a printed label, being the printed linerless label cut by the cutter, and to adhere an upstream end portion in a feeding direction of the printed label to a downstream end portion in a feeding direction of a subsequent printed label fed subsequent to the printed label; and a control unit configured to receive a setting for an upper limit of the number or length of printed labels that are issued to be linked to each other in a front-rear direction, and stop issuance of the printed label when the number or length of printed labels reaches the upper limit.

22. The label printer according to claim 21, further comprising:

a detection sensor configured to detect presence or absence of the issued printed label at a label issuing port, wherein the control unit stops issuance of the next printed label if the printed label is detected by the detection sensor after the number or length of the printed labels reaches a predetermined number or predetermined length at the label issuing port.

23. The label printer according to claim 22, wherein the control unit proceeds to issue the next printed label if removal of the printed label at the label issuing port is detected by the detection sensor before the number or length of the printed labels at the label issuing port reaches the predetermined number or predetermined length.

24. The label printer according to claim 23, wherein the control unit obtains the number or length of the printed labels at the label issuing port every time the printed label is issued.

25. The label printer according to claim 24, wherein when the control unit determines removal of the printed label from the label issuing port based on a detection signal provided by the detection sensor, the control unit clears the number or length of the printed labels at the label issuing port obtained in advance.

26. The label printer according to claim 25, wherein when print contents of the printed label to be subsequently issued are different from print contents of the printed label most recently issued, the control unit stops issuance of the printed label to be subsequently issued until removal of the printed label at the label issuing port is no longer detected by the detection sensor.

* * * * *